US005737948A

United States Patent [19]

Lefkovits

[11] Patent Number: 5,737,948

[45] Date of Patent: Apr. 14, 1998

[54] ACCESS CONTROL SYSTEM

[76] Inventor: Jacob Lefkovits, 1061 53rd St., Brooklyn, N.Y. 11219

[21] Appl. No.: 767,913

[22] Filed: Dec. 17, 1996

[51] Int. Cl.[6] ..... B65D 55/14

[52] U.S. Cl. ..... 70/164; 70/452; 70/455; 70/416; 70/427

[58] Field of Search ..... 70/163, 164, 166–169, 70/416, 417, 423, 424, 427, 428, 450, 452, 455, 337–343, DIG. 30

[56] References Cited

U.S. PATENT DOCUMENTS

| | | | |
|---|---|---|---|
| 1,256,132 | 2/1918 | Hillburg | 70/202 |
| 2,036,776 | 4/1936 | Rubner | 70/DIG. 30 X |
| 3,768,284 | 10/1973 | Kent et al. | 70/104 |
| 4,075,879 | 2/1978 | Christopher | 70/337 |
| 4,316,371 | 2/1982 | Del Nero | 70/452 X |
| 4,712,403 | 12/1987 | Markisello | 70/452 X |
| 4,873,853 | 10/1989 | Foshee | 70/452 |
| 5,010,748 | 4/1991 | Derman | 70/164 |
| 5,181,406 | 1/1993 | Wolter | 70/DIG. 30 X |
| 5,224,364 | 7/1993 | Claar et al. | 70/DIG. 30 X |
| 5,267,461 | 12/1993 | Eizen | 70/452 X |
| 5,375,444 | 12/1994 | Smith | 70/337 X |
| 5,400,628 | 3/1995 | Ryan | 70/417 |
| 5,598,323 | 1/1997 | Muller | 70/DIG. 30 X |

*Primary Examiner*—Suzanne Dino Barrett
*Attorney, Agent, or Firm*—Collard & Roe, P.C.

[57] ABSTRACT

An access control system for preventing access to underlying fasteners, and otherwise preventing tampering with the underlying control panel. A base plate is affixed to a base that is fastened to the underlying structure with standard fasteners. A cover plate is slidably disposed over the base plate and includes a key operated cylinder plug. The cylinder plug is inserted through the cover plate, base plate and into a receiving aperture in the base. A locking mechanism within the cylinder plug engages the base, and prevents the sliding disposition of the cover plate from the base plate.

6 Claims, 4 Drawing Sheets

ACCESS CONTROL SYSTEM

BACKGROUND OF THE INVENTION

1. Field of the Invention

The present invention relates to control panels. More particularly, it relates to an access control system for preventing access and tampering with the fasteners that hold a control panel in place.

2. The Prior Art

U.S. Pat. No. 1,256,132 to E. V. Hillburg, discloses a lever lock. The invention consists of a base plate and locking plate that are coupled together using a sliding configuration. The base plate is securely fastened with screws, and the locking cover plate conceals the heads of the screws. A centrally disposed cylinder lock actuates several locking fingers that engage the base plate and secures the sliding locking plate in place when the top end is secured around a lever.

U.S. Pat. No. 5,400,628 to Ryan, discloses a guard plate for locks. The invention consists of a cover plate having a central opening for accommodating the lock cylinder, and peripheral edges that have bendable tangs. An additional two plates that are disposed under the cover plate are disclosed. The second plate is fastened to the door using bolts. The first plate has slotted openings that are positioned over the heads of the bolts extending through the second plate such that the heads of the bolts pass through the first plate slotted openings. Once the bolt heads pass through the openings, the first plate is laterally displaced to secure the bolts within the slotted portion of the opening. The cover plate is fastened to the first plate by bending the bendable tangs over the peripheral edges of the combined first and second plates.

The patent to Kent et al., U.S. Pat. No. 3,768,284, discloses a maximum security lock assembly. The assembly shows the use of an armor outer plate that has the securing bolts permanently affixed to the underside of the plate.

SUMMARY OF THE INVENTION

According to the invention, a base plate is secured to the structure or other permanently located area through the use of conventional fasteners. A cover plate slides over the base plate and is secured in place using a key lock cylinder plug. Once locked in place, the cover plate prevents access to the underlying fasteners in the base plate, and further prevents tampering with the keylock and/or access control mechanism disposed under the access control panel. The keylock cylinder has a locking pawl that releasably extends into the cylinder plug chamber of the base and thereby retains the cylinder within the base and further prevents removal of the cover plate from the base plate.

In a particular embodiment, the key lock cylinder is a dual key cylinder having a control or access key for actuating the locking pawl, and another general key for actuating the access mechanism behind the access control panel. The control or access key locks and unlocks the locking pawl that secures the cylinder plug within the base and prevents removal of the cover plate. Limited personnel will have the control key. The general key fits within the cylinder plug and actuates a switch or other mechanism for performing a predetermined function. A much larger number of personnel staff will be given a general key.

It is therefore an object of the present invention to provide an access control system that prevents unauthorized access to the control panel fasteners.

It is another object of the invention to provide an access control system which can be employed with any key or button control panel.

Yet another object of the invention is to provide an access control system that operates efficiently and reliably and is easy to manufacture.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings were designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
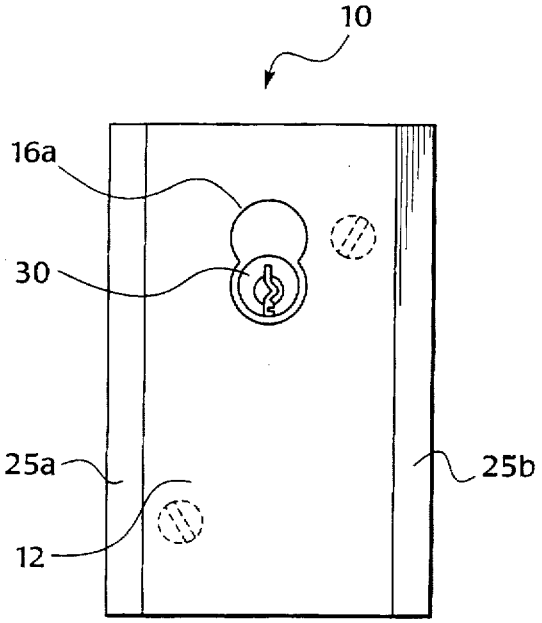
FIG. 1*a* is a front view of a first embodiment of the access control system according to the invention.
Figure 2A:
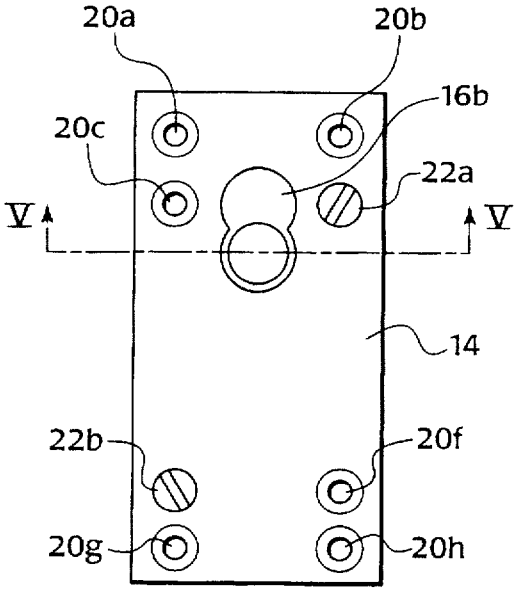
FIG. 2*a* is a top view of the base of the access control system according to the first embodiment of the invention.
Figure 1B:
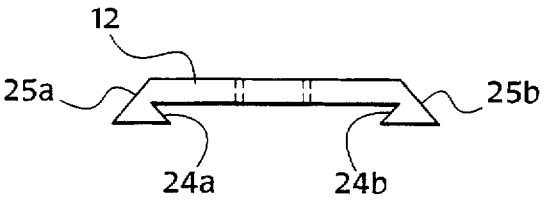
FIG. 1*b* is a side view of the access control plate according to the first embodiment of the invention.
Figure 2B:
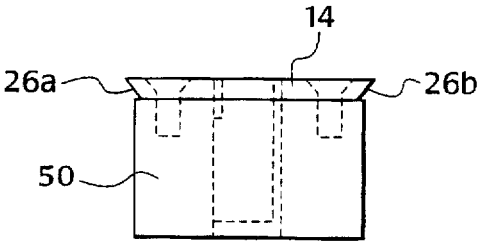
FIG. 2*b* is a side view of the base of FIG. 2*a*.
Figure 3A:
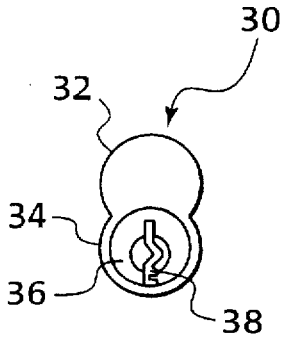
FIG. 3*a* is a front view of the access control cylinder plug according to the invention.
Figure 4A:
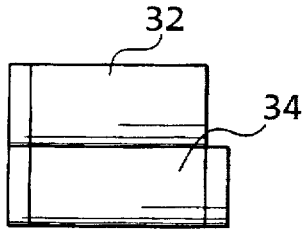
FIG. 4*a* is a right side view of the access control cylinder plug according to the invention.

Turning now in detail to the drawings, FIGS. 1*a*, 1*b*, 2*a* and 2*b* show the access control system 10 according to a first embodiment of the invention. System 10 includes a cover plate 12, a base plate 14 and a key operated cylinder plug 30. Cover plate 12 has beveled outer edges 25*a* and 25*b* and on the underside has two grooves or channels 24*a* and 24*b*. Cover plate 12 has a cylinder plug opening 16*a* for receiving cylinder plug 30, and base plate 14 has a similar opening 16*b* for receiving the same cylinder plug.

Base plate 14 has several apertures 20*a*–20*h* for receiving fasteners such as screws 22*a* and 22*b*. Apertures 20*a*–20*h* are chamfered to enable screws 22*a* and 22*b* to be flush with the top of base plate 14 and not obstruct the sliding disposition of cover plate 12. Screws 22*a* and 22*b* securely fasten base plate 14 to base 15. Base plate 14 has angled edges 26*a* and 26*b* such that cover plate 12 is slidably engaged with the base plate and edges 26*a* and 26*b* are received by grooves 24*a* and 24*b*, respectively. Once positioned on base plate 14, cover plate 12 is secured in place by cylinder plug 30.

FIGS. 3*a*, 3*b*, 4*a* and 4*b* show cylinder plug 30 having an upper portion 32 and a lower portion 34. The lower portion 34 includes the keyway 38 and rotating portion 36. A locking pawl 40 is disposed within cylinder plug 30 and is disposed along the circumference of lower portion 34 as shown. Upon insertion of a control key, portion 38 is slightly rotated in direction 39 to retract locking pawl 40 into plug 30. Once retracted, cylinder plug 30 can be inserted through cylinder plug openings 16*a* and 16*b* such that when completely inserted, the control key can be rotated in the opposite direction as 39 and thereby extend locking pawl 40 into base 50.

Figure 5:
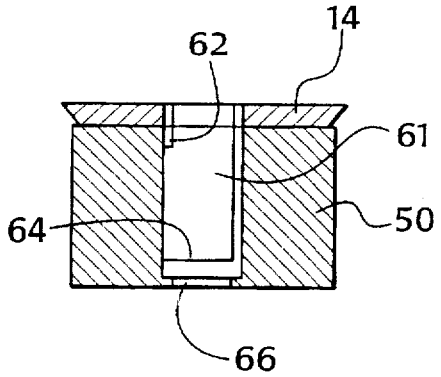
FIG. 5 is a cross-sectional view of the access control system taken along line V—V of FIG. 2*a;*

FIG. 5 shows a cross-section of base 50 and base plate 14. Base 50 has a cylinder plug chamber 61 that includes a step 64, an aperture 66, and a flange 62. When cylinder plug 30 is inserted into chamber 61, the upper portion 32 is disposed against step 64 such that the extended end 44 of lower portion 34 is axially aligned with aperture 66. Once inserted, locking pawl 40 can be actuated and disposed in the locking position. When locked, locking pawl 40 abuts flange 62 and prevents the removal of cylinder plug 30 from the cover plate 12. Cylinder plug 30 is now secured within base 50 and the top thereof is flush with cover plate 12 (FIG. 1*a*) and thereby prevents the removal of the cover plate from its sliding engagement with base plate 14.

Figure 3B:
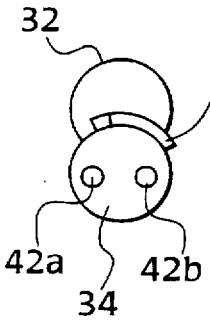
FIG. 3*b* is a rear view of the access control cylinder plug according to the invention.
Figure 4B:
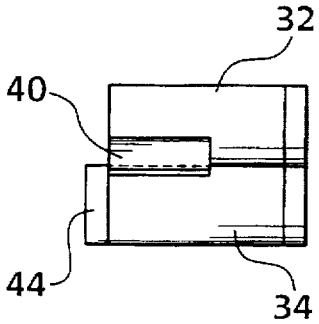
FIG. 4*b* is a left side view of the access control cylinder plug according to the invention.

FIG. 3*b* shows the rear of cylinder plug 30 having coupling apertures 42*a* and 42*b*. Coupling apertures 42*a* and 42*b* are for connecting said cylinder plug to a mechanical or electro-mechanical device for operation. When a second general key is inserted into keyway 38, it will not operate locking pawl 40, rather it will rotate apertures 42*a* and 42*b*. The rear of cylinder plug 30 can be modified according to the specific use or coupling desired. For example, apertures 42*a* and 42*b* could be replace with levers, or cams.

Figure 6:
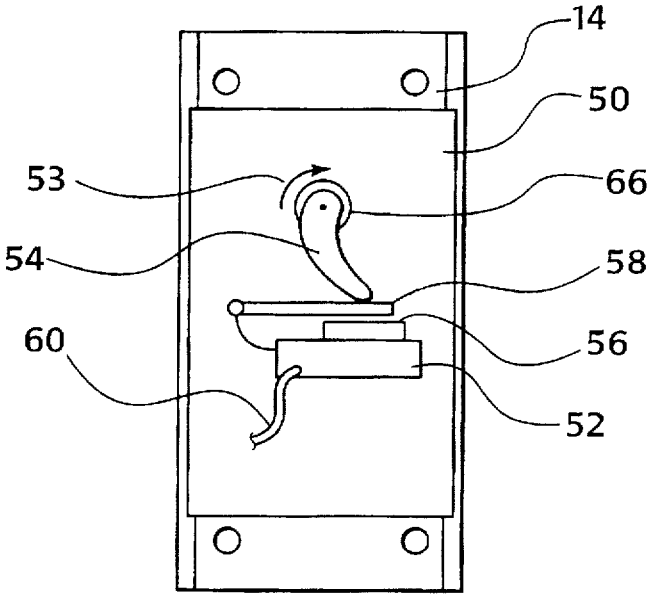
FIG. 6 is a rear view of the access control base according to the first embodiment of the invention.
Figure 7A:
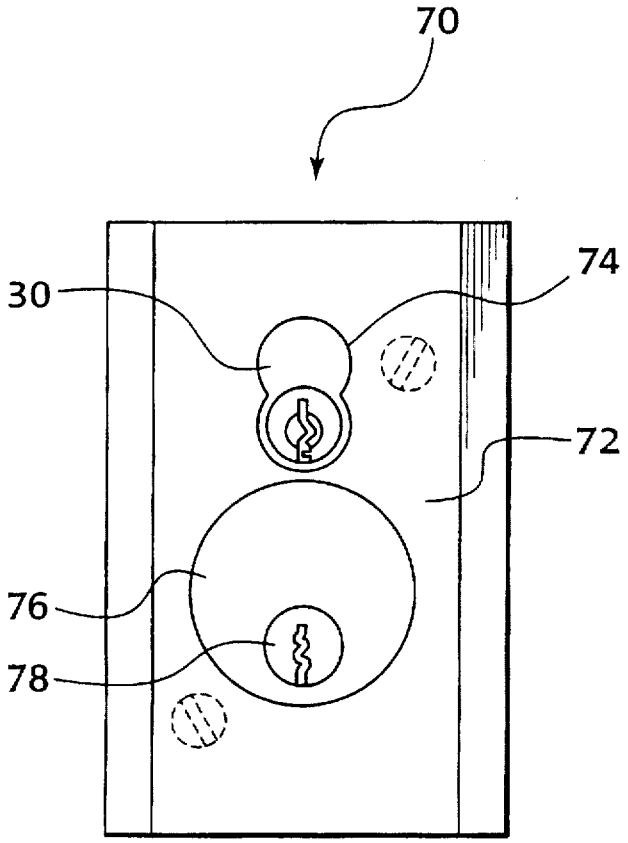
FIG. 7*a* is a front view of an access control plate according to a second embodiment of the invention.
Figure 8A:
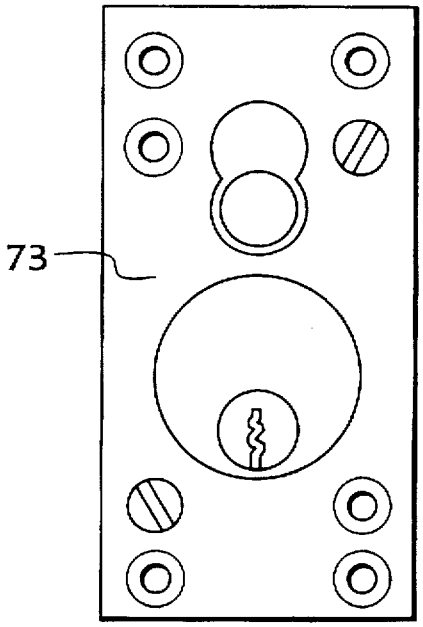
FIG. 8*a* is a top view of the base of the access control system according to the second embodiment of the invention.
Figure 7B:
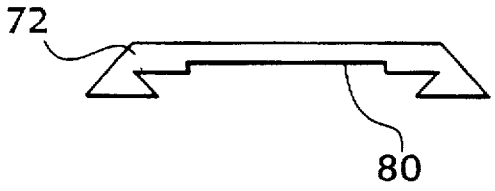
FIG. 7*b* is a side view of the access control plate of FIG. 7*a;*
Figure 8B:
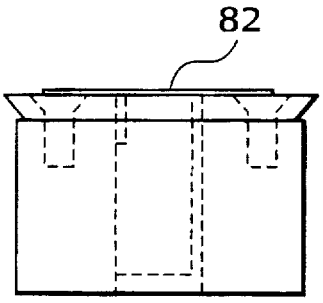
FIG. 8*b* is a side view of the base of FIG. 8*a;*

FIG. 6 shows an example of an electric switch 52 coupled to base 50. Electric switch 52 has a first contact 56 and a second contact 58. A cam 54 is connected to the rear of cylinder plug 30 through aperture 66. Upon rotation of cam 54 in direction 53, said cam will engage contact 58 and cause it to touch contact 56, complete the circuit and thereby actuate switch 52. Electric switch 52 can be any suitable known switch, and can be used to perform any desired switching function.

FIGS. 7*a*, 7*b*, 8*a* and 8*b* show an alternative embodiment of the access control system according to the invention. In this embodiment, cover plate 72 includes a provision for an additional keylock and cylinder. Cover plate has a slotted opening 80 for slidably receiving keylock 76. Keylock 76 can be used to control and locking or switching function, while cylinder plug 30 remains as the means for locking cover plate 72 in position over base plate 73 and thereby preventing access to the mounting fasteners, or to the cylinder of keylock 76.

Figure 9A:
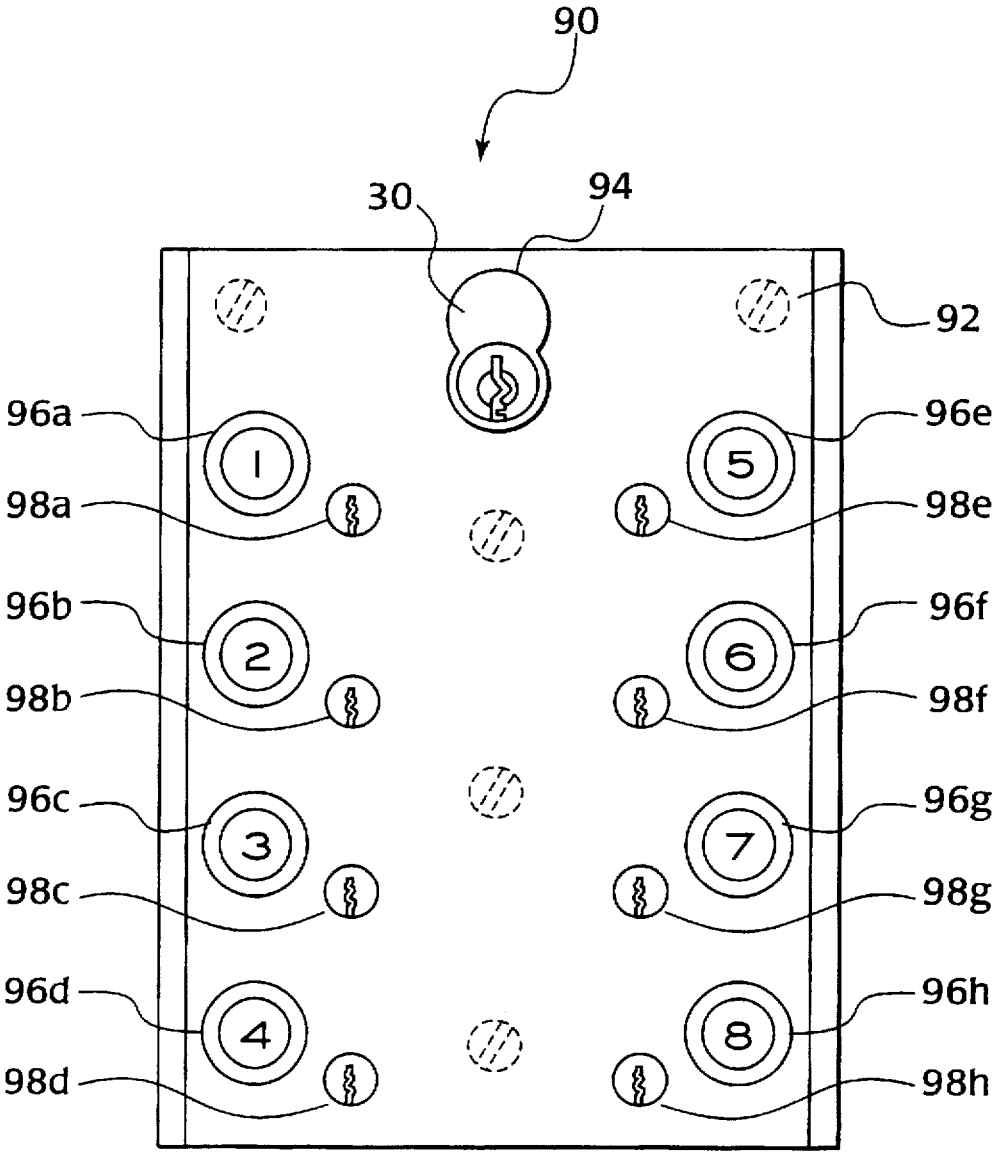
FIG. 9*a* is a front view of an access control panel for elevators according to another embodiment of the invention.
Figure 9B:
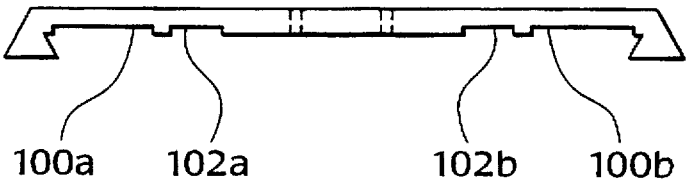
FIG. 9*b* is an end view of the access control panel of FIG. 9*a*.

FIGS. 9*a* and 9*b* show a third alternative embodiment for the access control system of the invention. The access control system 90 shows the implementation of the system with an elevator panel. Cylinder plug 30 locks the access plate 92 in place such that no unauthorized person can access the screws 91*a*–91*f* under the panel, or the cylinders of keyways 98*a*–98*h*. Access plate 92 has slotted cutouts 100*a*, 100*b*, 102*a* and 102*b* for fitting around buttons 96*a*–96*h*, and keyways 98*a*–98*h* .

While one embodiment of the present invention have been shown and described, it is to be understood that many changes and modifications may be made thereunto without departing from the spirit and scope of the invention as defined in the appended claims.

What is claimed is:

1. An access control system for preventing access to the underlying workings of a control panel comprising:

a base member having an upper surface, a lower surface, and a bore extending from said upper surface to said lower surface;

a base plate having two opposite sides, a plurality of fastening apertures and a bore, said base plate being fastened to said upper surface of said base member such that said bore in said base plate is aligned with said bore in said base member;

a cover plate having an upper surface, a lower surface, and a bore extending between said upper and lower surfaces, said bore being aligned with said base plate bore when said cover plate is placed over said base plate;

a dual key operated cylinder plug having a keyway on one end and connection means for coupling said cylinder plug to a rotation controlled device on the opposite end, said cylinder plug being disposed through said bores in said base member, base plate and cover plate, said dual key operated cylinder plug having a first operational mode that secures said cover plate over said base plate to prevent tampering with said cylinder plug, said first operational mode controlled by a control key that enables removal of the cylinder plug, and a second operational mode determined by a general key for access control.

2. The access control system according to claim 1, wherein said base member further comprises a flange disposed within said bore near said top surface.

3. The access control system according to claim 2, wherein said cylinder plug further comprises a locking pawl disposed on a side thereof, said locking pawl being extended outward from said plug when said plug is disposed within said bores of said base member, base plate, and cover plate, said locking pawl abutting said flange in said base member bore to secure said cylinder plug and thereby secures said cover plate to said base plate to define said first operational mode.

4. The access control system according to claim 3, wherein said locking pawl is actuated by the first control key.

5. The access control system according to claim 3, wherein said edges of said base plate are beveled, and said lower surface of said cover plate includes grooves for slidably receiving said beveled edges of said base plate.

6. The access control system according to claim 4, wherein said rotation controlled device coupled to said end of said cylinder plug comprises a switching device coupled to said lower surface of said base member, said switching device being actuated by said general key that rotates said end of said cylinder plug to define said second operational position.

* * * * *